US010231891B2

(12) United States Patent
Howell et al.

(10) Patent No.: US 10,231,891 B2
(45) Date of Patent: Mar. 19, 2019

(54) MODULAR FLUIDIZABLE OCCUPANT SUPPORT AND COMPACT FLUIDIZABLE MODULES

(75) Inventors: Charles A Howell, Batesville, IN (US); Scott Peer, Woodbury, MN (US)

(73) Assignee: Hill-Rom Services, Inc., Batesville, IN (US)

( * ) Notice: Subject to any disclaimer, the term of this patent is extended or adjusted under 35 U.S.C. 154(b) by 2122 days.

(21) Appl. No.: 12/694,543

(22) Filed: Jan. 27, 2010

(65) Prior Publication Data

US 2010/0229310 A1 Sep. 16, 2010

Related U.S. Application Data

(60) Provisional application No. 61/159,996, filed on Mar. 13, 2009.

(51) Int. Cl.
*A61G 7/057* (2006.01)

(52) U.S. Cl.
CPC ..... *A61G 7/05746* (2013.01); *A61G 7/05769* (2013.01)

(58) Field of Classification Search
CPC ..... A61G 7/05746; A61G 7/05769
USPC ..... 5/689, 702, 655.4, 911, 620, 611, 613
See application file for complete search history.

(56) References Cited

U.S. PATENT DOCUMENTS 452,304 A * 5/1891 Johnson et al. ..... 5/611
933,323 A * 9/1909 Mitchell ..... 5/611
4,483,029 A * 11/1984 Paul ..... 5/689
4,599,755 A * 7/1986 Tominaga ..... 5/689
4,694,521 A 9/1987 Tominaga
5,036,559 A * 8/1991 Hargest ..... 5/689
5,134,737 A * 8/1992 Wyman ..... 5/600
5,623,736 A * 4/1997 Soltani et al. ..... 5/689
5,680,661 A * 10/1997 Foster et al. ..... 5/618
5,687,437 A * 11/1997 Goldsmith ..... 5/611
(Continued)

FOREIGN PATENT DOCUMENTS

WO 1996033641 A1 10/1996
WO 1999023991 A1 5/1999

OTHER PUBLICATIONS

Hill-Rom Clinitron® Air Fluidized Therapy Brochure, © 2004 Hill-Rom Services, Inc., 1069 State Road 46 East Batesville, IN 47006, www.hill-rom.com, USA—800-638-2546.
(Continued)

*Primary Examiner* — Eric J Kurilla
(74) *Attorney, Agent, or Firm* — Kenneth C. Baran

(57) ABSTRACT

An occupant support includes at least one non-fluidizable module 100 having a support structure for supporting the non-fluidizable module on a ground surface 76 and at least one fluidizable module 66 also having a support structure for supporting the fluidizable module on the ground surface. The fluidizable and non-fluidizable modules cooperate with each other to support an occupant. The support for the non-fluidizable module bears less than all the weight of the fluidizable module and, in the limit bears none of the weight. An alternative occupant support includes at least one non-fluidizable module and at least one fluidizable module cooperable with the fluidizable module to support an occupant. The fluidizable module is sized to support no more than about 50 percent of the length of an adult human body and most preferably no more than about 30 percent.

18 Claims, 13 Drawing Sheets

(56) References Cited

U.S. PATENT DOCUMENTS

| | | | | |
|---|---|---|---|---|
| 5,729,849 | A * | 3/1998 | Garakani | 5/618 |
| 5,950,262 | A * | 9/1999 | Smoler et al. | 5/613 |
| 6,101,647 | A * | 8/2000 | Stroud et al. | 5/618 |
| 6,158,070 | A * | 12/2000 | Bolden et al. | 5/689 |
| 2006/0022504 | A1 | 2/2006 | Johnson et al. | |
| 2006/0085919 | A1 | 4/2006 | Kramer | |

OTHER PUBLICATIONS

Partial European Search Report; EP10250471; Place of Search—The Hague; Date of Completion of the Search—Dec. 3, 2012.
Partial European Search Report; EP10250471.9; dated Dec. 12, 2012; Place of Search—The Hague; Date of completion of the Search—Dec. 3, 2012.
Extended European Search Report; EP10250471.9; dated Apr. 4, 2013; Place of Search—The Hague; Date of Completion of the Search—Dec. 3, 2012.
EP Search Report Response for EP10250471.9; dated Oct. 22, 2013.
EP Search Report Response for EP10250471.9 Spec filed; dated Oct. 22, 2013.
EP Search Report Response for EP10250471.9; Claims filed; dated Oct. 22, 2013.
Extended European Search Report; EP15161490; dated Jun. 30, 2015; Place of search—The Hague, Date of completion of the search—Jun. 16, 20156.
EP Search Report Response for EP15161490.6 dated Feb. 2, 2016.
EP Search Report Response for EP15161490.6 dated Feb. 2, 2016; Amended Pages (Tracked).
EP Search Report Response for EP15161490.6 dated Feb. 2, 2016; Amended Pages (Final).
EP Search Report Response for EP15161490.6 dated Feb. 2, 2016; Claims (Tracked).
EP Search Report Response for EP15161490.6 dated Feb. 2, 2016; Claims (Final).
EP Search Report Response for EP15161490.6 dated Feb. 2, 2016; Replacement Drawings p. 2 Filed.
Communication Pursuant to Article 94(3) EPC for EP15161490.6; dated Jun. 22, 2016.
Response dated Nov. 2, 2016 to Communication Pursuant to Article 94(3) for EP Application No. 15161490.6 dated Jun. 22, 2016.
Amended Page for EP Application No. 15161490.6 (Track Change).
Amended Page for EP Application No. 15161490.6 (Final).
Claims for EP Application No. 15161490.6 (Track Change).
Claims for EP Application No. 15161490.6 (Final).
Communication pursuant to Article 94(3) EPC; EP Application 15161490.6; dated Nov. 30, 2016; received Dec. 9, 2016.
European Search Report for Application 17175517.6; dated Sep. 22, 2017; Place of Search—The Hague; Date of completion of the search—Sep. 13, 2017.
Response to European Search Report for Application 17175517.6 dated Apr. 27, 2018.
Claims (Clean) for European Application 17175517.6.
Claims (Tracked) for European Application 17175517.6.
Description (Clean) pp. 2-2A for European Application 17175517.6.
Description (Tracked) pp. 2-2A for European Application 17175517.6.
Communication under Rule 71(3) EPC for European Application 17175517.6 dated Sep. 4, 2018.
Druckexemplar for European Application 17175517.6.

* cited by examiner

MODULAR FLUIDIZABLE OCCUPANT SUPPORT AND COMPACT FLUIDIZABLE MODULES

This application claims priority to U.S. provisional application 61/159,996 entitled "Modular Fluidizable Occupant Support and Compact Fluidizable Modules" filed on Mar. 13, 2009.

TECHNICAL FIELD

The subject matter described herein relates to fluidizable occupant supports and particularly to a modular fluidizable occupant support and a compact fluidizable module for use as a component of the modular occupant support or as a stand-alone unit.

BACKGROUND

Health care professionals may recommend the use of fluidizable beds for patients who suffer from skin disorders or who would be at significant risk of developing skin disorders as a result of occupying a non-fluidizable bed. A typical fluidizable bed includes a vessel and a porous diffuser board or plate separating the interior volume of the vessel into a supply plenum and a fluidizable medium receptacle. The supply plenum is connected to a source of pressurized gas, usually ambient air that has been compressed by a compressor. A fluidizable particulate material, usually in the form of small beads, resides in the fluidizable medium receptacle. A liner is secured to the containment vessel near a rim thereof. A filter sheet is joined to the liner at a seam. The seam is tight enough to resist migration of the beads through the seam and ideally is also substantially fluid-tight. A gas permeable vent region of the filter sheet extends across the top of the containment vessel. The vent region has pores that are small enough to resist migration of the beads through the filter sheet. When the fluidizable bed is not in a state of fluidized operation, the vent region of the filter sheet is in a slack or relaxed state.

During fluidized operation, pressurized air enters the air distribution chamber, flows through the diffuser partition and the fluidizable material, and exhausts through the filter sheet. The velocity of the air flowing through the material "fluidizes" the material so that the material and air, taken together, exhibit fluid-like properties. As a result, the occupant of the bed is supported on a quasi-fluid having a specific gravity greater than that of the occupant. Such a system of support is beneficial for occupants suffering from skin disorders or at significant risk of developing skin disorders.

One drawback of fluidizable beds is the weight of the fluidizable material and the transportability of the bed as a whole. Fluidizable beds typically weigh about 1000-1600 pounds (455-727 kg.), a considerable portion of which is the weight of the fluidizable material. Because of the specialized nature of fluidizable beds, they are frequently rented, rather than owned, and must therefore be frequently transported from one site to another. Even if a bed is owned, for example by a health care facility, it may need to be regularly transported from room to room. The weight is obviously a disadvantage in a frequently transported product. In addition, fluidizable beds may be used in a home care setting where the building structure may not be designed to support such heavy weight. Moreover, the fluidizable material must be periodically cleaned, usually at a site remote from the bed. The large volume and weight of the fluidizable material contributes to the cost, time and effort required to carry out the cleansing. The above drawbacks are amplified in fluidizable beds designed for heavier occupants, including bariatric occupants.

SUMMARY

The subject matter disclosed herein reflects a recognition that not all patients require fluidized support across their entire body length and that providing support over less than the full length of the patient's body can yield noteworthy reductions in the weight and maintenance cost of a fluidizable occupant support as well as improvements in transportability of the support.

An occupant support as disclosed herein comprises at least one non-fluidizable module having a support structure for supporting the non-fluidizable module on a ground surface and at least one fluidizable module also having a support structure for supporting the fluidizable module on the ground surface. The fluidizable module and the non-fluidizable module are cooperable with each other to support an occupant. The support structure for the non-fluidizable module is designed to bear less than all of the weight of the fluidizable module.

Also disclosed herein is an occupant support including at least one non-fluidizable module and at least one fluidizable module cooperable with the non-fluidizable module to support an occupant. The fluidizable module is sized to support less than the full length of an adult human body.

Also disclosed herein is a compact fluidizable module useable as a component of the occupant support or as a stand-alone unit.

The features of the various embodiments of the occupant support described herein will become more apparent from the following detailed description and the accompanying drawings.

DETAILED DESCRIPTION

Figure 1:
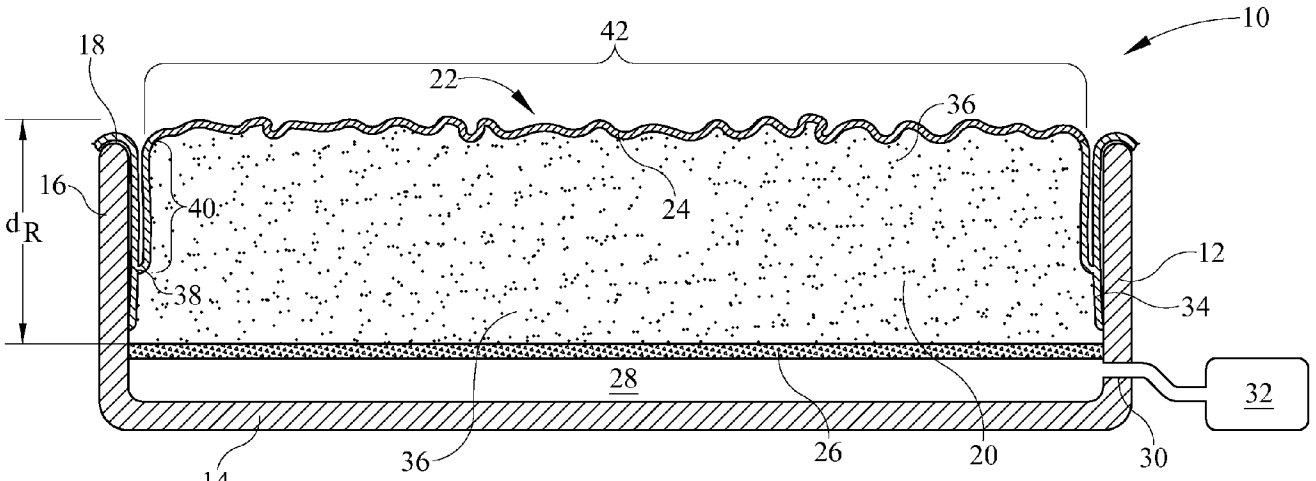
FIG. 1 is a schematic end view of a fluidizable bed in a rest or non-fluidized state.

FIG. 1 shows a typical non-modular fluidizable bed 10 in a rest or non-fluidized state. The bed includes a containment vessel 12 having a bottom 14 and a gas impermeable perimeter wall 16 extending upwardly from the vessel bottom to a wall rim 18. The wall 16 may be in the form of an air bladder. The top 22 of the vessel is open except for the presence of a filter sheet 24 described more completely below. A porous diffuser partition 26, often called a diffuser board or plate or simply a diffuser, cooperates with vessel wall 16 and bottom 14 to define a distribution chamber or supply plenum 28. A gas inlet 30 penetrates wall 16. The bed also includes a blower 32, which is not operating when the bed is in its rest state. The diffuser board and filter sheet bound a fluidizable medium receptacle 20. A quantity of a fluidizable material 36, such as silicon dioxide beads having a diameter on the order of about 0.001 inches (0.0254 centimeters), occupies at least part of the volume of the receptacle 20 and may fill the vessel to a level slightly higher than the rim 18 as depicted in the illustration. The fluidizable material has a nominal rest depth $d_R$. The diffuser partition 26, although gas permeable, resists passage of the fluidizable material therethrough.

The bed also includes a liner 34 secured to the containment vessel. A snap fit seam 38 joins the filter sheet 24 to the liner. The seam is tight enough to resist migration of the beads past the seam. Ideally the seam is also fluid-tight. The filter sheet includes a substantially impermeable containment region 40 extending along the perimeter wall 16, and also has a permeable vent region 42 overlying the top of the vessel. When the blower is not operating, at least the vent region of the filter sheet is in a slack or relaxed state. The vent region is constructed so that, despite its permeability, the beads cannot escape through the filter sheet.

Figure 2:
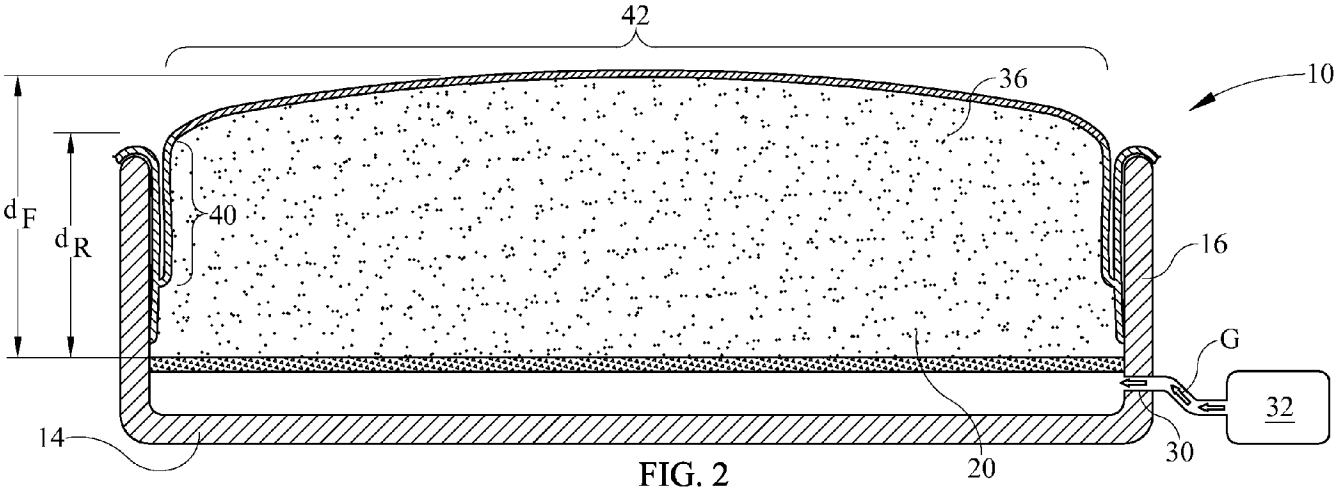
FIG. 2 is a view similar to that of FIG. 1 showing the bed in a powered or fluidized state.

FIG. 2 shows the bed in a powered or fluidized state. In the fluidized state the blower is operating and pressurizes a gaseous fluid G, usually ambient air, causing the air to enter the distribution chamber by way of the gas inlet 30. The air then flows through the diffuser partition and the beads 36 and exhausts through the vent region 42 of the filter sheet. The velocity of the air flowing through the fluidizable material causes fluidization of the material so that the fluidized medium (i.e. the air and the material 36, taken together) acts as a quasi-fluid exhibiting fluid-like properties. The fluidized material has a fluidized depth $d_F$ which slightly exceeds its rest depth $d_R$.

Some beds of the type described above are constructed so that the fluidized medium supports an occupant throughout all of the occupant's length (height). Other beds are constructed so that the fluidized medium supports the occupant over less than all of the occupant's length, but nevertheless over a large proportion of his or her length. The large volume of beads gives rise to the disadvantages previously described.

Figure 3:
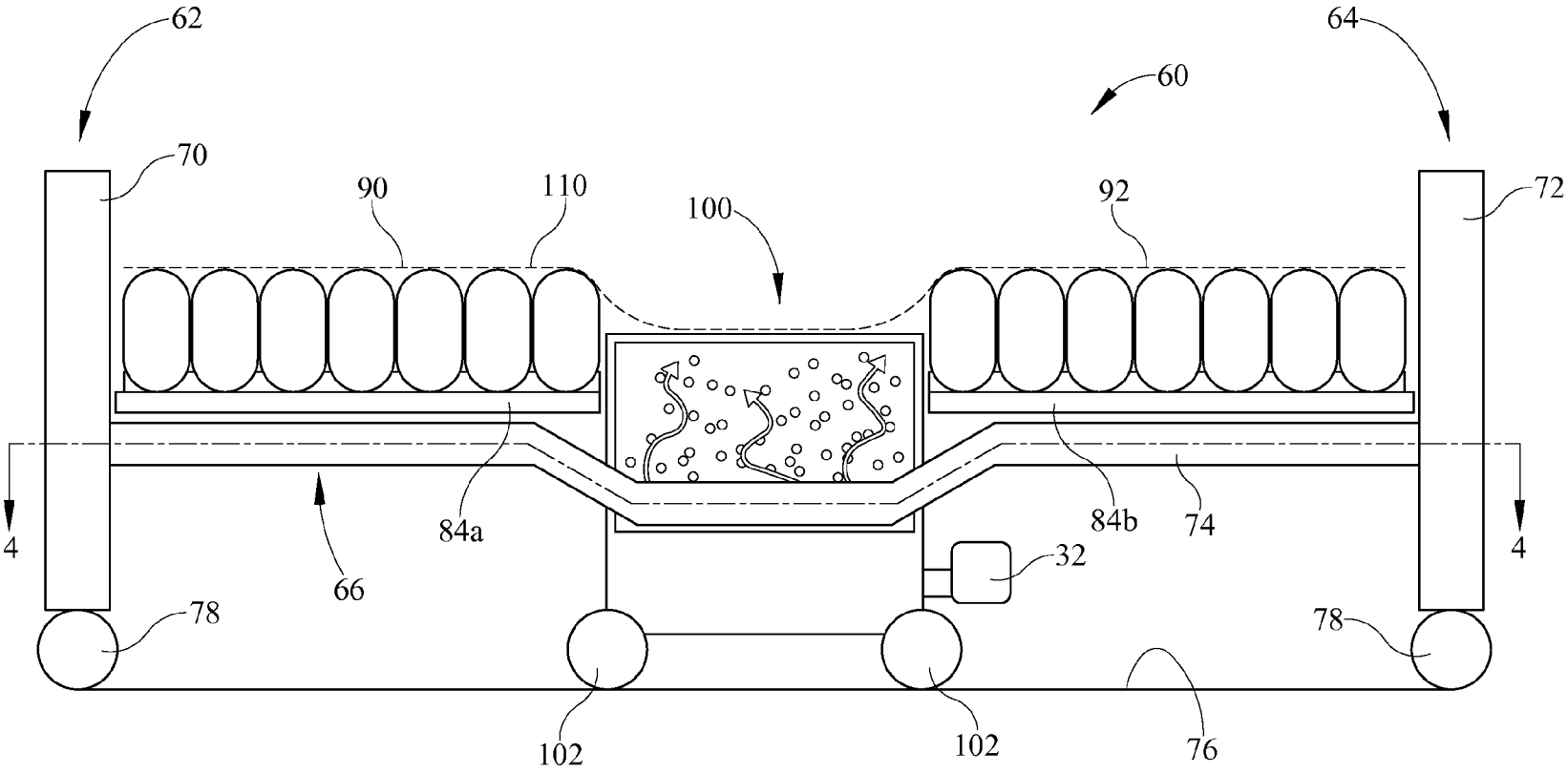
FIG. 3 is a schematic, side elevation view of a bed having a fluidizable module and a non-fluidizable module, the support for the non-fluidizable module bearing less than all of the weight of the fluidizable module.
Figure 5:
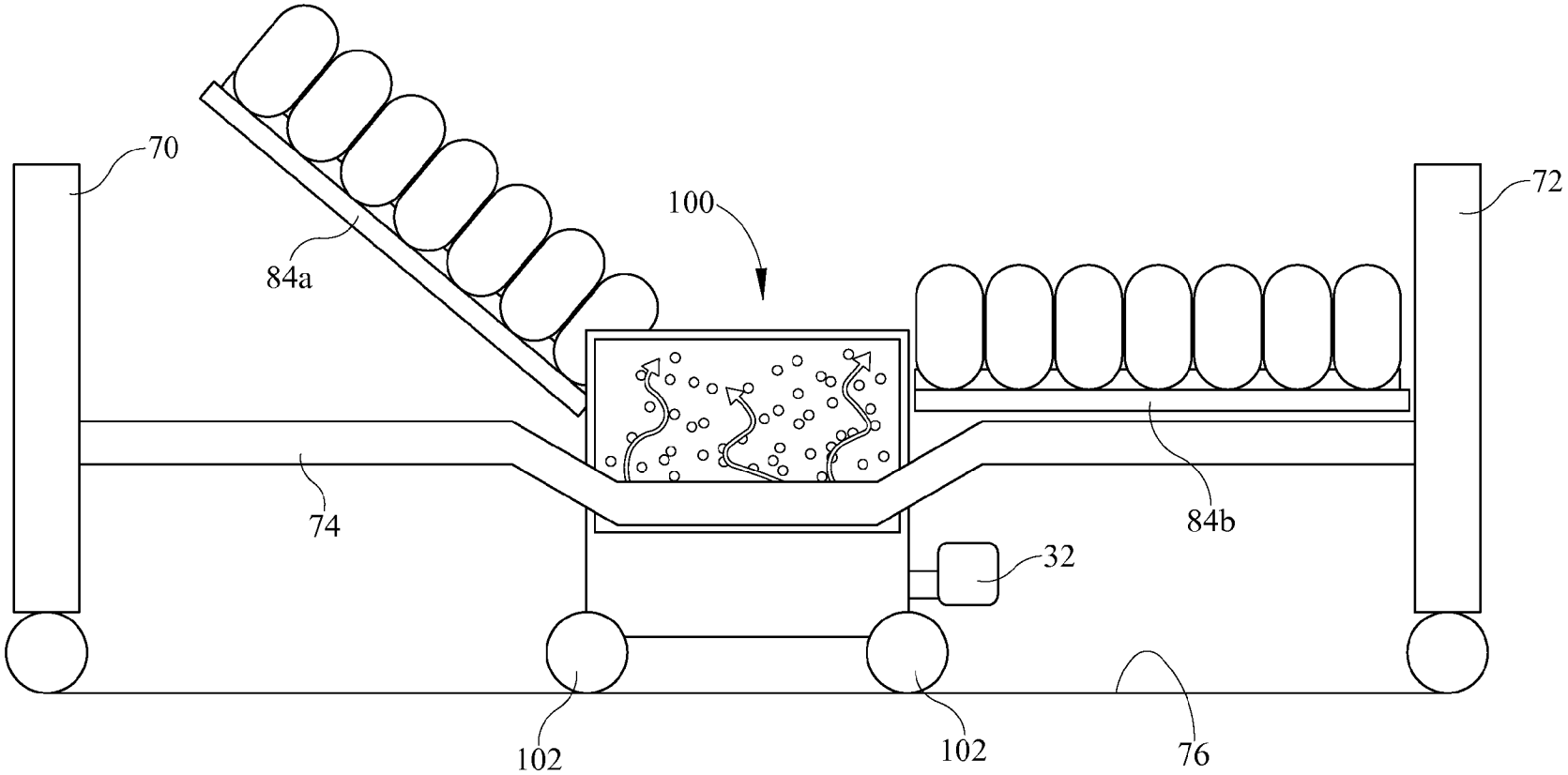
FIG. 5 is a view similar to FIG. 3 showing the bed with its upper body deck angularly displaced from the frame.
Figure 6:
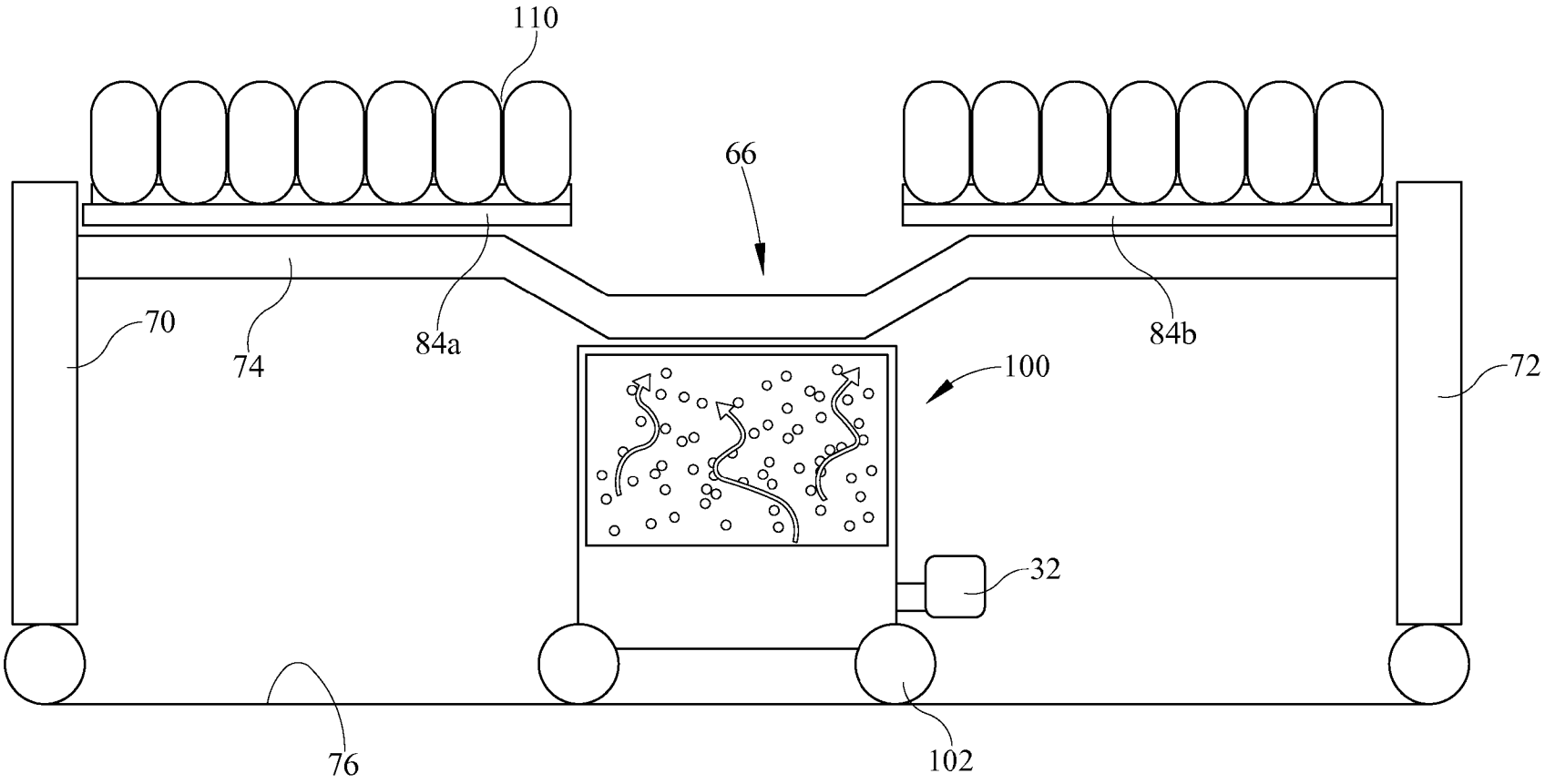
FIG. 6 is a view similar to FIG. 3 showing the bed with its frame elevated to facilitate mating or unmating of the fluidizable module with the non-fluidizable module.

FIG. 3 shows an occupant support in the form of a hybrid bed 60 having fluidizable and non-fluidizable modules. The bed extends longitudinally from a head end 62 to a foot end 64 and extends laterally from a left side to a right side. The bed includes a non-fluidizable module 66 comprised of a head unit 70, a foot unit 72 and a frame 74 extending longitudinally between the units. The non-fluidizable module includes a support structure that supports the non-fluidizable module on a ground surface 76, such as a floor. In the illustrated embodiment the support structure includes the frame, portions of the head and foot units below the frame, and wheels 78. The frame supports a deck 84 comprising an upper body deck section 84*a* and a leg deck section 84*b*. One or more deck sections of the non-fluidizable module are adjustable relative to the rest of the non-fluidizable module. For example, FIG. 5 illustrates the upper body deck having been angularly displaced from the frame. As seen in FIG. 6, the frame 74 is elevatable relative to the floor.

Each deck section accommodates a non-fluidizable cushion such as cushions 90 and 92. Alternatively, the deck sections may be omitted and the cushions installed directly on the frame, if desired. Cushions 90, 92 are illustrated as air bladders, but may be foam or any other non-fluidizable construction. The cushions can be built in to the deck sections or frame or may be user separable from the deck sections or frame. The phrase "user separable" means that the cushions can be removed from the deck section or frame without the use of special tools, skills or knowledge. For example the cushions are user separable if they can be removed and installed by the attending medical staff in a health care facility or by a home caregiver rather than requiring the intervention of maintenance or service personnel.

Figure 4:
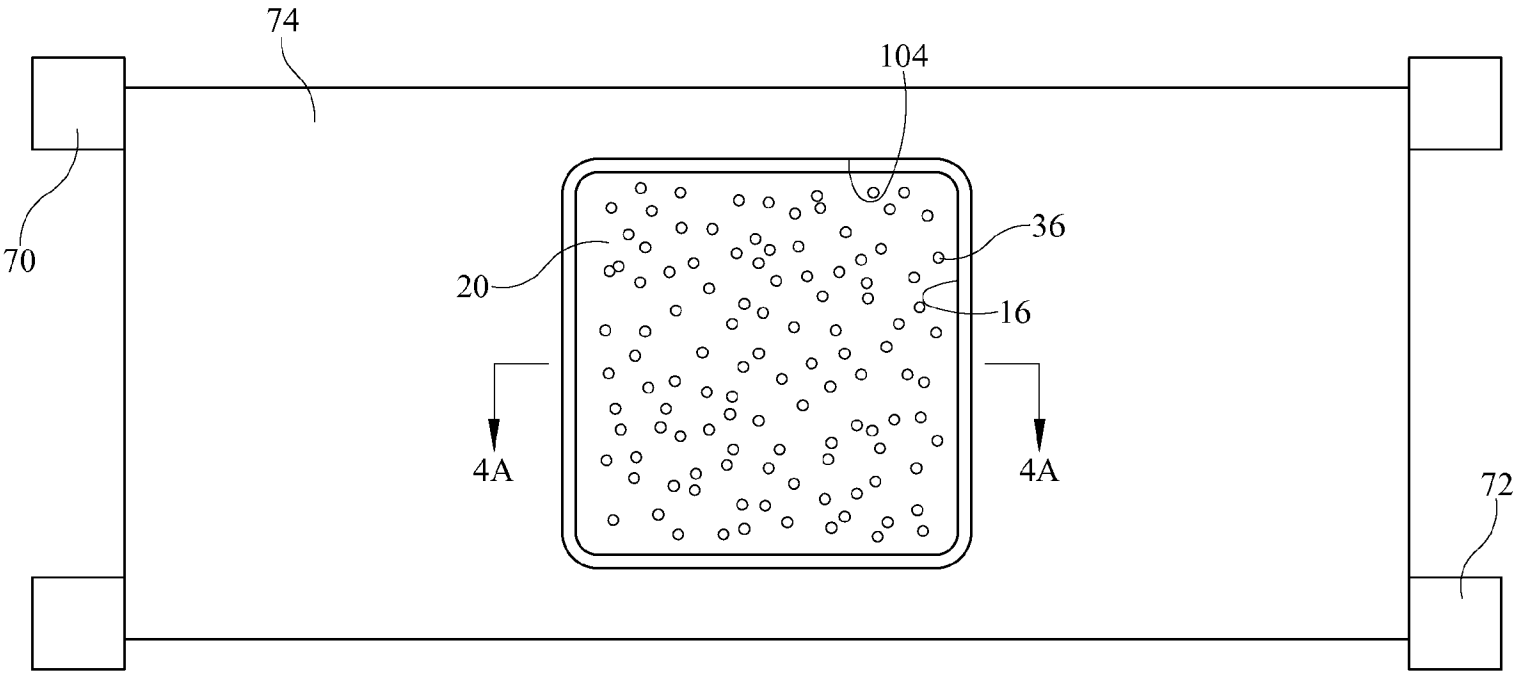
FIG. 4 is a view in the direction 4-4 of FIG. 3.
Figure 7:
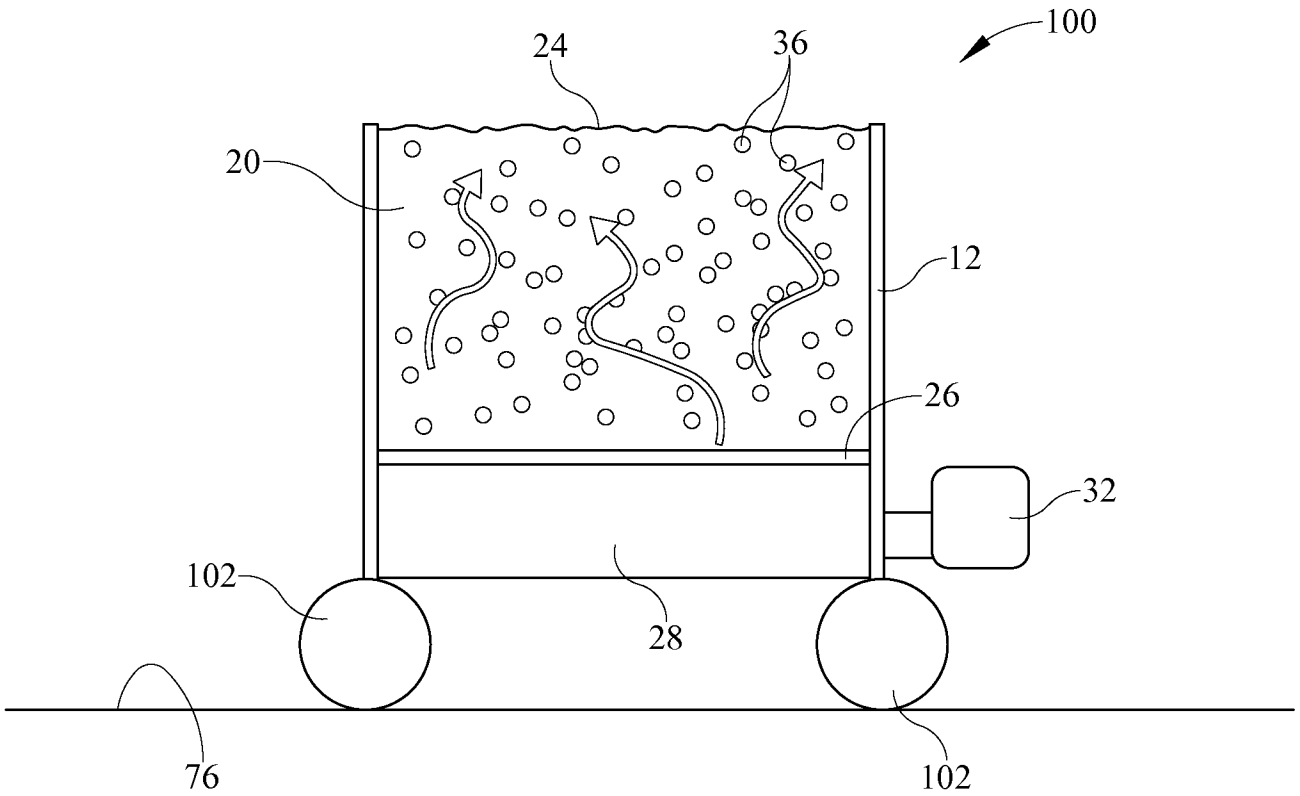
FIG. 7 is a view of the fluidizable module in isolation.

The occupant support also includes a fluidizable module 100, shown in isolation in FIG. 7, whose construction and operation is similar to that of the non-modular fluidized bed described above. That is, the module 100 has a containment vessel 12 a filter sheet 24 secured to the containment vessel and a diffuser plate 26 separating an interior volume of the vessel into a supply plenum 28 and a fluidizable medium receptacle 20. The fluidizable medium receptacle is also bounded by the filter sheet 24. A fluidizable medium 36 resides in the fluidizable medium receptacle. The fluidizable module includes a support structure, which may include the containment vessel 12 and wheels 102, to support the fluidizable module on a ground surface 76, such as a floor. The wheels also impart mobility to the fluidizable module. The fluidizable module, when powered so that it is in its fluidized state, serves as a cushion. As seen in FIG. 4, the fluidizable module is aligned with an opening 104 in the frame of the non-fluidizable module. The fluidizable module is sized to be able to accommodate no more than about 50% of the length of a human body, preferably no more than about 40% of the length of a human body and even more preferably no more than about 30% of the length of a human body. The length of the human body is the length determined from generally accepted anthropometric data. One source of such data is found in "The Measure of Man and Woman, Human Factors in Design, Revised Edition" Alvin R. Tilley, Henry Dreyfuss Associates, John Wiley & Sons, Inc., ISBN 0-471-09955-4, 2002. Another source is "PeopleSize 2000 Easy Version 2.06a", Open Ergonomics Limited. More specifically the length of a human body may be taken to be that of a 95th percentile male which is about 73.7 inches (approximately 187 centimeters) for a US male age 20-64 years according to the first source and about 77.8 inches (approximately 198 centimeters) for a US male age 18-64 years according to the second source.

Figure 8:
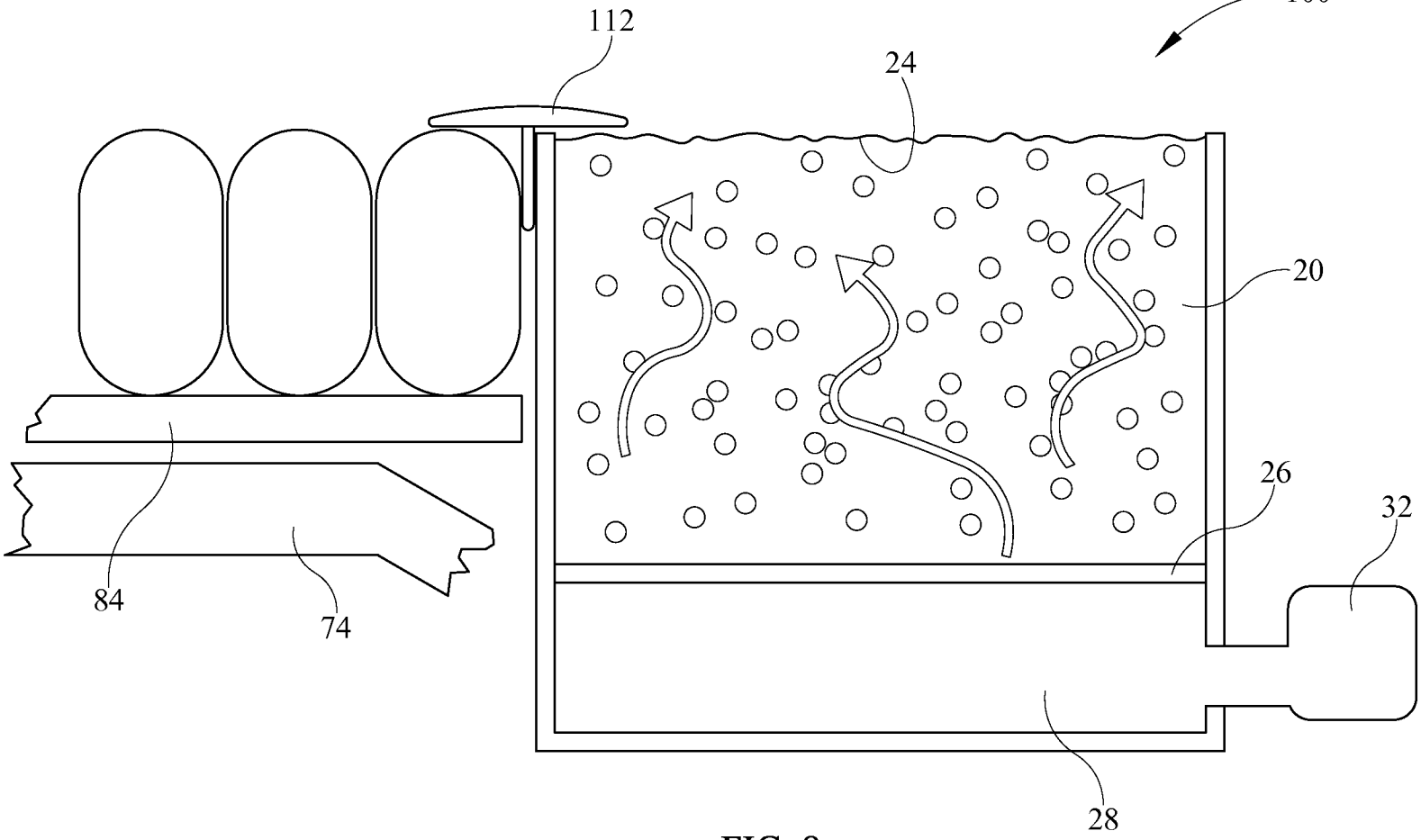
FIG. 8 is an enlarged view of an interface region between a fluidizable module and a non-fluidizable module showing an inter-cushion filler.

Referring to FIG. 3, fluidizable and non-fluidizable modules are cooperable with each other to define a surface 110 for supporting an occupant. The profile of the surface is indicated by the dashed line in FIG. 3. As seen in FIG. 3 the unoccupied surface may have a nonuniform elevation to compensate for the fact that an occupant will sink into the bladders (or foam if a foam medium is used) and that the surface of the fluidizable medium may be slightly higher when fluidized than when at rest. It should be appreciated that the illustrations are schematic, and therefore the amount of nonuniformity depicted in the illustrations is not necessarily representative of the nonuniformity that might be present in an actual occupant support. If desired an inter-cushion filler 112 (FIG. 8) can be provided to bridge from a cushion to the adjacent cushion.

As is evident from FIGS. 3, 5, and 6, the support structure for the non-fluidizable module bears none of the weight of the fluidizable module. All of the weight of the fluidizable module is supported by its own support structure. In some circumstances it may be desirable to link the fluidizable module to the non-fluidizable module in a way that the support structure for the non-fluidizable module bears a portion of the weight of the fluidizable module, but nevertheless bears less than all of the weight of the fluidizable module and preferably substantially less than all of the weight of the fluidizable module.

Due to the hybrid character of the modular occupant supports described above, only part of the occupant is supported by the fluidizable module. Such partial fluidized support may be satisfactory for occupants who require the benefits of the fluidized medium along only a portion of their body. Because the fluidizable module 100 is compact in comparison to prior fluidizable constructions, which are designed for all or nearly all of an occupant's length, the overall weight of the occupant support 60 is substantially reduced. Moreover, the fluidizable module 100 is separable from the non-fluidizable module, which further eases the burdens of transporting the occupant support. For example, the frame 74 of the non-fluidizable module can be raised as seen in FIG. 6, allowing a user to roll the fluidizable module 100 laterally away from the non-fluidizable module. The modules may then be individually transported to their next destination. The nonfluidizable module 66 is easily transported because it is no longer burdened by the weight of the fluidizable medium and by the longitudinally nonuniform weight distribution that would otherwise result from the presence of the fluidizable module. The fluidizable module is readily portable and highly maneuverable because of its compact size and relatively low weight. At the destination, the fluidizable module is rolled underneath the non-fluidizable module. The nonfluidizable module is then lowered to re-constitute the occupant support as seen in FIG. 3.

Figure 4A:
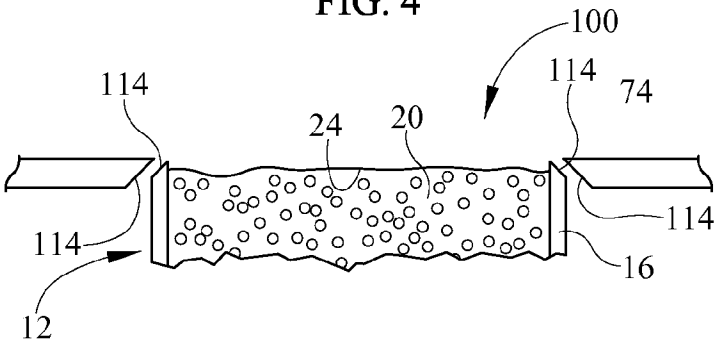
FIG. 4A is a view in the direction 4A-4A of FIG. 4

Referring to FIG. 4A the frame 74 and the rim of the containment vessel 12 may include piloting features that allow the modules to mate without requiring high precision pre-positioning of the fluidizable module under the non-fluidizable module. Such piloting features may include chamfers 114 along the rim of the vessel and the mating portions of the frame.

The fluidizable module may be height adjustable relative to the floor instead of or in addition to the frame being height adjustable relative to the floor in order to facilitate mating and unmating of the fluidizable and non-fluidizable modules.

Figure 9:
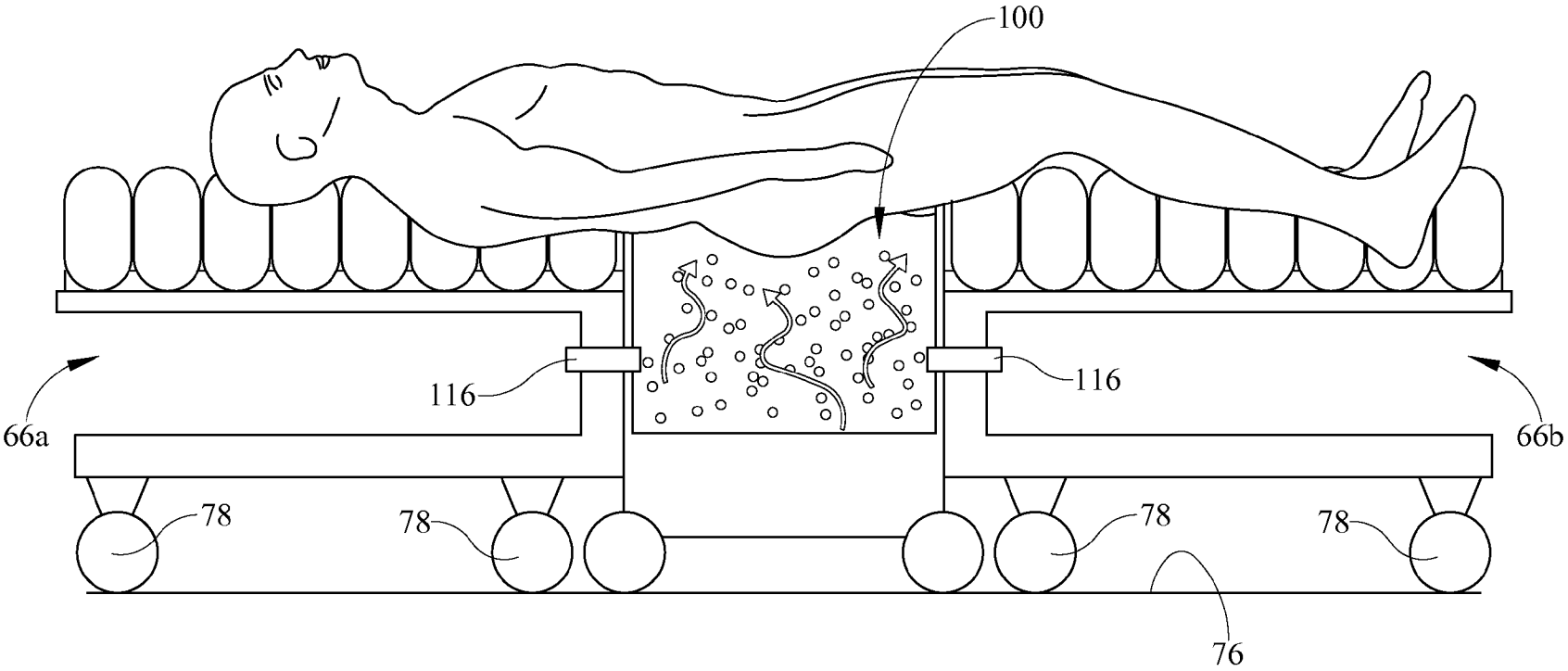
FIG. 9 is a schematic, side elevation view showing a bed having a fluidizable module and a pair of non-fluidizable modules.

FIG. 9 is an occupant support similar to that of FIGS. 3, 5 and 6. Whereas the occupant support of FIGS. 3, 5 and 6 have a single fluidizable module and a single non-fluidizable module, the occupant support of FIG. 9 has a single fluidizable module 100 and a pair of non-fluidizable modules 66*a*, 66*b* longitudinally bracketing the fluidizable module. As with the previously described embodiments, the support structure for the non-fluidizable module bears less than all of the weight of the fluidizable module and, in the limit, bears none of the weight of the fluidizable module. All of the weight of the fluidizable module is supported by its own support structure. FIG. 9 also schematically shows a coupling 116 connecting each of the non-fluidizable modules to the fluidizable module to prevent unintended longitudinal separation of the modules. In general, the quantity of fluidizable modules and non-fluidizable modules is at least three and all of the at least three modules are supportable on the ground surface 76 such that less than all of the weight of the fluidizable module is supported by the support structure of the non-fluidizable module and, in the limit, none of the weight of the fluidizable module is supported by the support structure of the non-fluidizable modules.

Figure 10:
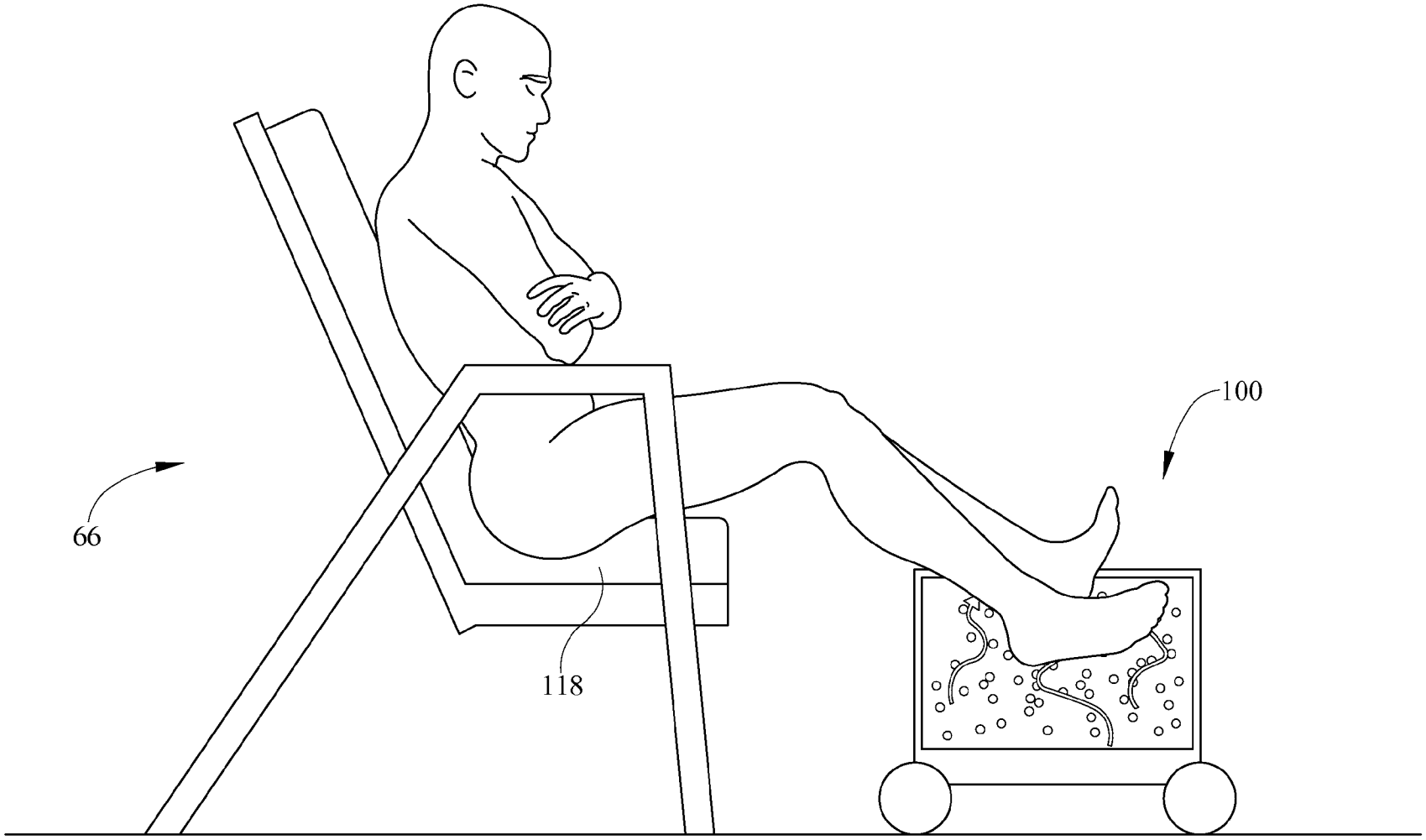
FIG. 10 is a schematic, side elevation view showing an arrangement in which the non-fluidizable module is a chair of conventional design.

FIG. 10 shows a variant in which the non-fluidizable 66 module is a chair 118 of essentially conventional design.

Figure 11:
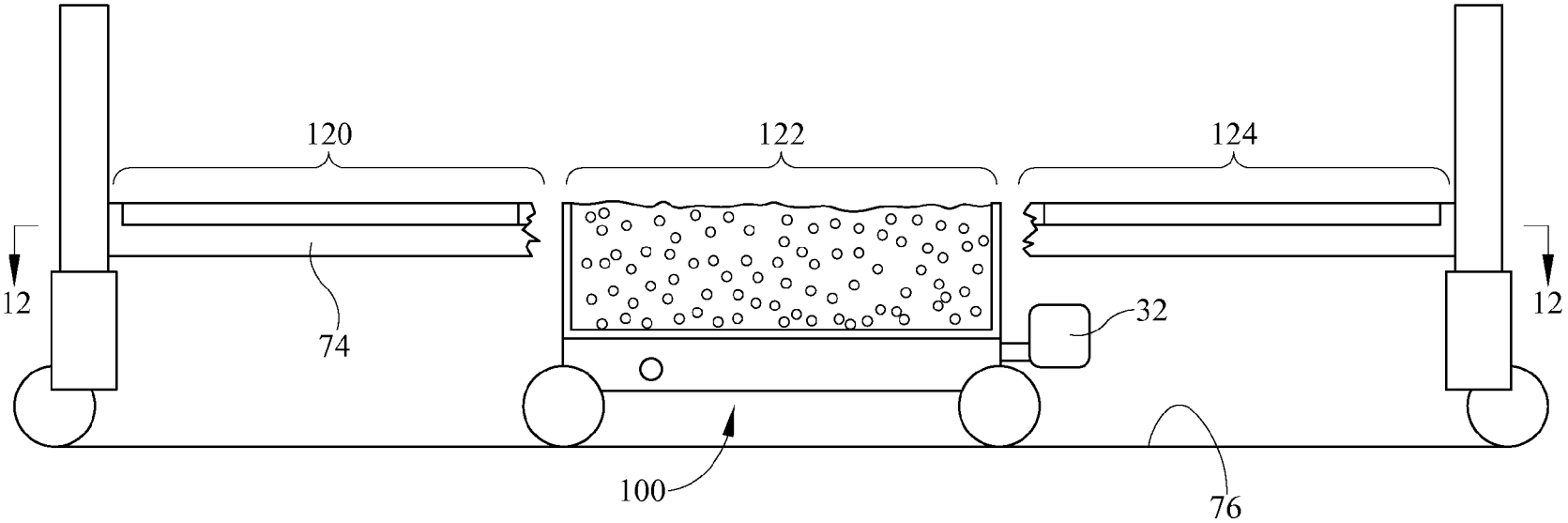
FIG. 11 is a schematic, side elevation view of a bed having multiple stations, one of which is occupied by a fluidizable module.
Figure 12:
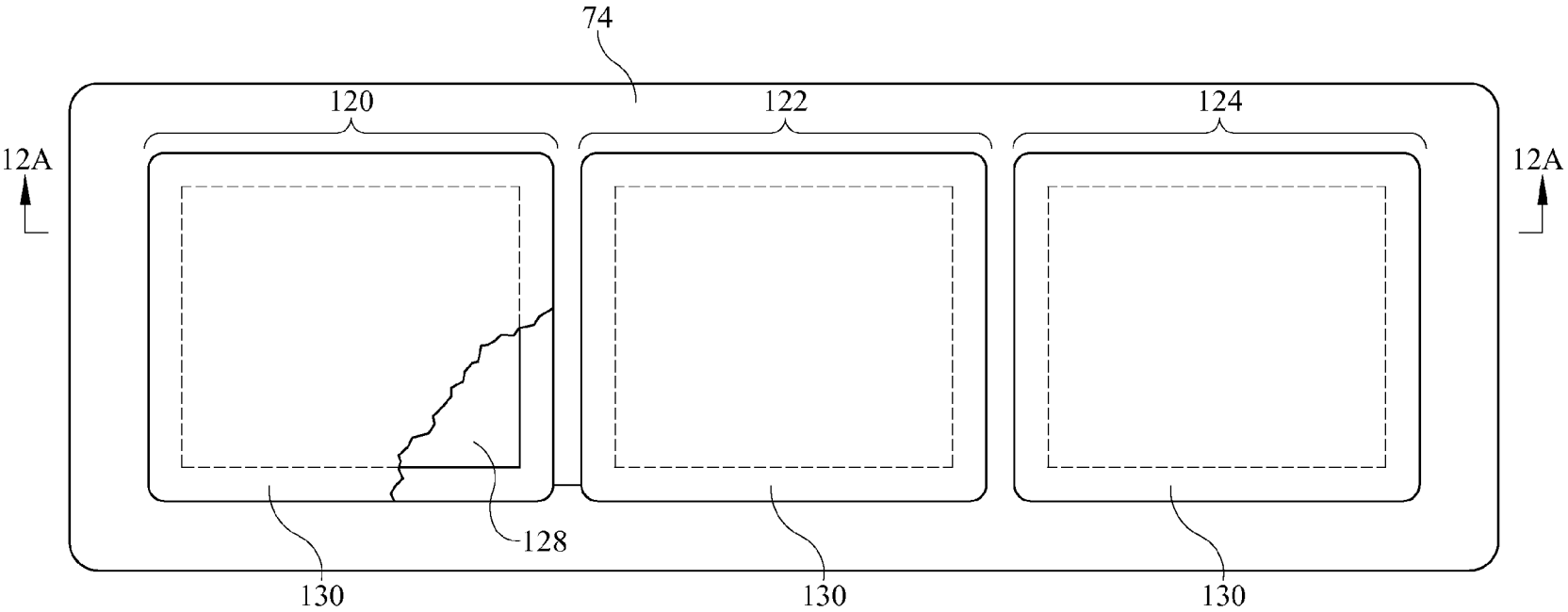
FIG. 12 is a view in the direction 12-12 of FIG. 11 showing the bed frame, an opening in the frame corresponding to each of the stations and a removable cover for closing each opening.
Figure 12A:
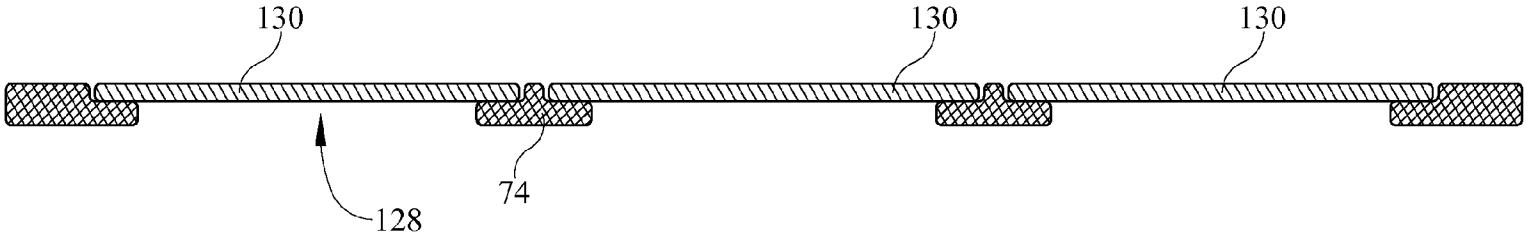
FIG. 12A is a view in the direction 12A-12A of FIG. 12.

FIGS. 11, 12, and 12A show a variant of the occupant support. The nonfluidizable module includes a frame 74 with at least two stations. The illustrated occupant support has three stations 120, 122, 124. At least one of the stations is capable of receiving a fluidizable cushion, e.g. a fluidizable module. In the illustration all three stations are capable of accommodating a fluidizable cushion. Each of these stations includes an opening 128. The occupant support includes a removable cover 130 for occupying the opening when the station is not used to accommodate a fluidizable module. When the cover is in place at a station, the station cannot accommodate a fluidizable module whose weight is not borne, at least in part, by the non-fluidizable module. However the station can accommodate a non-fluidizable cushion. For example the cover might be removed from station 122 so that a fluidizable module 100 can be used at that station, and the covers might be left in place at stations 120, 124. Non-fluidizable cushions comprising air bladders and/or foam pads would then be installed at stations 120 and 124. If all three stations were used for fluidizable modules, the occupant support would still have certain advantages over non-modular fluidizable beds, namely that transportability would be easier due to the ability to separate the fluidizable modules from the rest of the occupant support (i.e. from the non-fluidizable module) and transport the modules individually.

Figure 13:
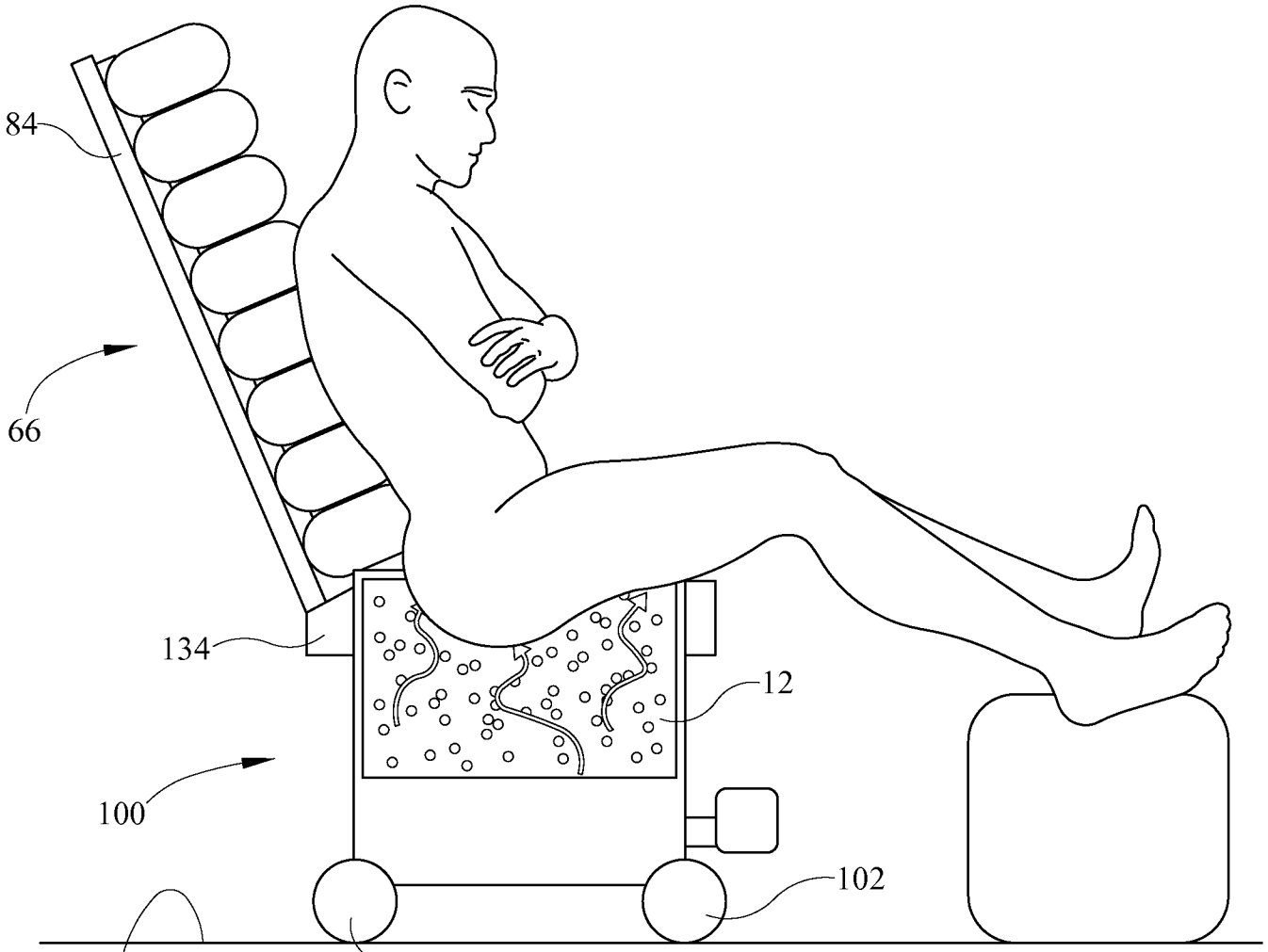
FIG. 13 is schematic, side elevation view of an occupant support having a fluidizable module and a non-fluidizable module supported on the fluidizable module and in which the fluidizable module is sized to accommodate no more than a predefined fraction of the length of a human occupant.

Referring now to FIG. 13 an occupant support comprises at least one fluidizable module 100 and at least one non-fluidizable module 66 secured to the fluidizable module. The modules are cooperable with each other to support an occupant. The fluidizable module is sized to be able to accommodate no more than about 50% of the length of a human body, preferably no more than about 40% of the length of a human body and even more preferably no more than about 30% of the length of a human body. The length of the human body is the length determined from generally accepted anthropometric data as noted previously. The occupant support of FIG. 13 has a support structure for supporting the occupant support on a ground surface 76. The fluidizable module and the non-fluidizable module share a common support structure as a result of the weight of the non-fluidizable module being conveyed to the vessel 12 and thence to the ground surface 76. Specifically, the deck portion 84 of the non-fluidizable module is pivotably connected to a bracket 134 which, in turn, is connected to or is an integral part of the containment vessel 12. The weight of the non-fluidizable module is transferred to the bracket, the vessel and finally to the wheels 102 and the floor.

The fluidizable module may also be used as a stand-alone device rather than in conjunction with a non-fluidizable module. For example the fluidizable module shown in isolation in FIG. 7 can be employed in a stand-alone role. As before, the fluidizable module is sized to be able to accommodate no more than about 50% of the length of a human body, preferably no more than about 40% of the length of a human body and even more preferably no more than about 30% of the length of a human body as determined from generally accepted anthropometric data as noted previously. For example the module 100 might be sized to accommodate only the forearm and hand of a person, in which case the wheels 102 may not be necessary.

Figure 14:
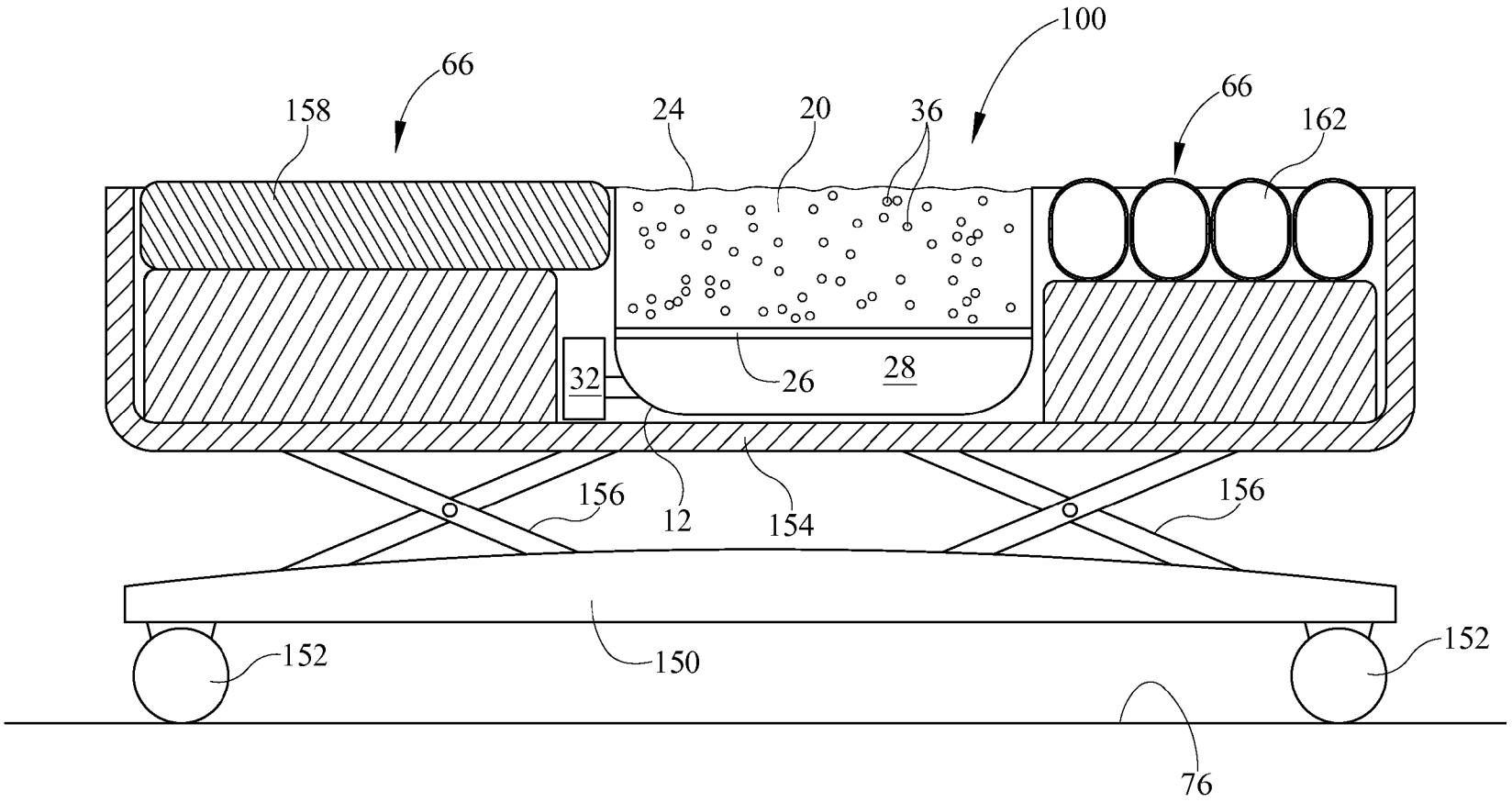
FIG. 14 is schematic, side elevation view of a modular bed having a fluidizable module, two non-fluidizable modules, and a support structure. At least part of the support structure supports the combined weight of all the modules.

Referring to FIG. 14 an occupant support includes a base frame 150 with wheels 152 for supporting the base frame on ground surface 76. The occupant support also includes an elevatable frame 154 and a lift mechanism, for example a scissors lift 156 for changing the elevation of the elevatable frame relative to the elevation of the base frame. The elevatable frame supports a fluidizable module 100 of the type already described and two non-fluidizable modules 66. The non-fluidizable module near one longitudinal end of the occupant support is a foam cushion 158. The non-fluidizable module near the other longitudinal end of the occupant support is a bladder based cushion 162. The support structure for the modules includes the wheels 152, base frame 150, scissors lift 156 and elevatable frame 154. Although the illustration shows different types of non-fluidizable modules (foam and bladder), the two non-fluidizable modules could be of the same type. The non-fluidizable modules could also be a construction other than foam or bladders. As few as two modules can be used, one fluidizable and the other non-fluidizable. Three or more modules can also be used, in which case at least one module is a fluidizable module and the other modules are non-fluidizable. Each fluidizable module is sized to be able to accommodate no more than about 50% of the length of a human body, preferably no more than about 40% of the length of a human body and even more preferably no more than about 30% of the length of a human body as determined from generally accepted anthropometric data as noted previously.

Although this disclosure refers to specific embodiments, it will be understood by those skilled in the art that various changes in form and detail may be made without departing from the subject matter set forth in the accompanying claims.

We claim:

1. An occupant support comprising:

at least one non-fluidizable occupant supportive module having a first support dedicated to supporting the non-fluidizable module on a ground surface;

at least one fluidizable occupant supportive module having a second support dedicated to supporting the fluidizable module on the ground surface, the fluidizable module including a fluidizable particulate material;

the fluidizable module and the non-fluidizable module being cooperable with each other to support an occupant.

2. The occupant support of claim 1 wherein at least one of the fluidizable module and the non-fluidizable module is elevation adjustable.

3. The occupant support of claim 1 wherein the fluidizable module is portable.

4. The occupant support of claim 3 wherein the fluidizable module is sized to support no more than about 30 percent of the length of an adult human body wherein the length of the adult human body is based on anthropometric data for an adult.

5. The occupant support of claim 4 wherein the length of an adult human body is the length of a 95th percentile male.

6. The occupant support of claim 1 wherein the fluidizable module is sized to support no more than about 30 percent of the length of an adult human body wherein the length of the adult human body is based on anthropometric data for an adult.

7. The occupant support of claim 6 wherein the length of an adult human body is the length of a 95th percentile male.

8. The occupant support of claim 1 wherein at least part of the non-fluidizable module is adjustable relative to the rest of the non-fluidizable module.

9. The occupant support of claim 1 wherein the fluidizable module comprises:

a containment vessel;

filter sheet secured to the containment vessel a diffuser plate separating an interior volume of the vessel into a supply plenum and a fluidizable medium receptacle, the fluidizable medium receptacle also being bounded by the filter sheet;

wherein the fluidizable material resides in the fluidizable medium receptacle.

10. The occupant support of claim 1 wherein the fluidizable material is in the form of beads.

11. The occupant support of claim 1 wherein the non-fluidizable module accommodates a cushion.

12. The occupant support of claim 1 wherein the non-fluidizable module includes a built-in cushion.

13. The occupant support of claim 1 wherein the non-fluidizable module includes a user separable cushion.

14. The occupant support of claim 1 wherein the non-fluidizable module includes at least two stations, at least one of the stations being capable of receiving a fluidizable cushion.

15. The occupant support of claim 14 wherein at least one of the stations is capable of receiving a non-fluidizable cushion.

16. The occupant support of claim 14 including cushions at each station and wherein an inter-cushion filler bridges from each cushion to an adjacent cushion.

17. The occupant support of claim 14 wherein each station capable of receiving a fluidizable cushion comprises a fluidizable module opening and the occupant support includes a cover for occupying the fluidizable module opening when the opening is not used to accommodate a fluidizable module.

18. The occupant support of claim 1 comprising at least one wheel secured to the fluidizable module.

* * * * *